United States Patent [19]

Ito et al.

[11] Patent Number: 4,840,509

[45] Date of Patent: Jun. 20, 1989

[54] SYNTHETIC RESIN PEN UNIT

[75] Inventors: Akio Ito; Hiroshi Kato, both of Aichi, Japan

[73] Assignee: Pilot Ink Co., Ltd., Japan

[21] Appl. No.: 108,675

[22] Filed: Oct. 15, 1987

Related U.S. Application Data

[60] Division of Ser. No. 9,542, Feb. 2, 1987, Pat. No. 4,721,404, which is a continuation of Ser. No. 878,396, Jun. 19, 1986, abandoned, which is a continuation of Ser. No. 202,815, Oct. 31, 1980, abandoned.

[51] Int. Cl.[4] ..... B43K 1/12; B43K 1/06; B43K 1/06

[52] U.S. Cl. ..... 401/198; 400/265

[58] Field of Search ..... 401/198, 199, 265

[56] References Cited

U.S. PATENT DOCUMENTS

| | | | |
|---|---|---|---|
| 3,627,868 | 12/1971 | Funahashi | 401/198 |
| 3,933,965 | 1/1976 | Gallone | 401/199 |
| 4,072,430 | 2/1978 | Otsuka | 401/265 |
| 4,076,428 | 2/1978 | Otake | 401/199 |
| 4,207,013 | 1/1980 | Shimoishi | 401/199 |

*Primary Examiner*—William Pieprz

*Attorney, Agent, or Firm*—Sughrue, Mion, Zinn, Macpeak & Seas

[57] ABSTRACT

A synthetic resin pen unit has a cylindrical outer annular member with inwardly extending bent and straight members. Each bent member has a base portion extending from the inner wall so that it is inclined with respect to a phantom line connecting the base of the bent member to the central axis of the cylindrical member. Ink grooves are formed between the inwardly extending members. The flexibility of the pan unit is a function of the percentage of bent members so that by proper selection and arrangement the pen characteristics can be optimized.

3 Claims, 2 Drawing Sheets

SYNTHETIC RESIN PEN UNIT

BACKGROUND OF THE INVENTION

This is a divisional application of Ser. No. 009,542, filed on Feb. 2, 1987 now U.S. Pat. No. 4,721,404, issued on Feb. 2, 1987 which is a continuation application of Ser. No. 878,396, filed on June 19, 1986 now abandoned which is a continuation application of Ser. No. 202,815, filed on Oct. 31, 1980 now abandoned.

This invention relates to synthetic resin pen units in writing devices. More particularly, it relates to a pen unit in the form of a bar which is obtained by fusing a number of synthetic resin elements in the axial direction thereof so that the pen unit comprises a cylindrical member which is annular in section having a number of linear members extending inwardly from the inner wall of the cylindrical member. An improved sectional structure results.

The structure of a synthetic resin pen unit of this type should satisfy the following conditions:

1. An ink passage has a size large enough to deliver an amount of ink required or consumed in writing.

2. The ink passage has a small width so that it can introduce the ink in the ink container of the writing device to the pen point and has capillary action to maintain the ink in the pen unit.

3. The sectional configuration of the ink passage concentrates ink to the center in section of the pen unit.

4. The pen unit is strong enough to withstand a writing pressure applied thereto.

In order to satisfy the above-described conditions (1), a pipe-shaped structure having a circular section ink passage is most effective. However, this structure cannot meet condition (2). In order to satisfy both conditions (1) and (2), it is necessary that the ink passage has a sectional configuration which is small in width and large in length and has a sectional area which is large enough to satisfy condition (1).

Furthermore, the writing device must be such that the user feels comfortable when writing with it. One of the factors which determine whether or not a writing device meets this requirement is the flexibility of the pen unit. Accordingly, the pen unit must be designed so that it has a desired flexibility.

Within the prior art a number of configurations have been proposed for pen units, typified by U.S. Pats. Nos. 3,932,044; 4,072,430 and 4,076,428. The hallmark of each of these prior art configurations is an attempt to maintain the necessary flexibility so that writing comfort is achieved, however, the above four defined conditions are to some extent sacrificed. U.S. Pat. No. 3,932,044 shows best in FIG. 2 of that patent a coreless configuration having curved thin radial slots formed between triangular segments. The triangular segments have different heights and alternate with each other in a symmetrical fashion. They are formed of a number of semi-circles to define a regular triangle and, under writing pressure, the curve segments of the opposite walls tend to engage each other. Under writing pressure, the center conduit or coreless design is maintained.

U.S. Pat. No. 4,072,430 is also directed to a "coreless" design nib shown best in FIG. 3 of that patent. This configuration utilizes an outer wall having a number of cantilevered inner partitions. Each partition is formed of intersecting semi-circles of alternating large and small diameters. As shown in the Figure, each of the inner partitions is formed by having a circle of a large diameter separated by one of a small diameter and additionally, each circle having the same diameter lies along a common circumferential circle about the nib. Circumferential capillary passages are provided in the outer wall.

U.S. Pat. No. 4,076,428 deals with a nib configuration utilizing a number of trunk portions which inwardly project toward the center. Each of the trunk portions have a series of branch elements in particular symmetrical relationships. Various degrees of fold symmetry are defined to achieve the orientation of the tree, stem, and branch portions of each inwardly projecting segment. Core-type configurations are shown in FIGS. 8 and 9 with the hallmark of the patent being the number of inwardly projecting stem portions in the required symmetry about the center.

In each of these prior art pen unit configurations, flexibility at the tip is attained at the expense of the requirements of ink passage delivery and/or structural integrity of the unit under writing pressure. Accordingly, there exists a requirement for an improved synthetic resin pen unit which satisfies the four above listed structural conditions yet attains the necessary flexibility of achieve writing comfort.

SUMMARY OF THE INVENTION

Accordingly, an object of this invention is to provide a synthetic resin pen unit which satisfies all of the abovedescribed conditions in an appropriate balance and achieves the desired flexibility in accordance with its intended use.

The pen unit according to the invention comprises: a cylindrical member which is annular in section; and members extending inwardly from the inner wall of the cylindrical member. The members are straight members and bent members, or only bent members. Each straight member extends straight from the inner wall of the cylindrical member towards the central axis of the cylindrical member. Each bent member has a base portion which extends from the inner wall of the cylindrical member in such a manner that it is inclined with respect to a phantom line connecting the base of the bent member to the central axis of the cylindrical member. Each bent member has a top portion which is bent towards the central axis of the cylindrical member. Gaps, i.e. ink grooves, are formed between these members. In this respect, as the percentage of the bent members occupying the sectional area of the cylindrical member is increased, the flexibility is increased.

Accordingly, a pen unit can have a desired flexibility by suitably selecting the ratio in number of the straight members to the bent members and the arrangement of the straight and bent members. More specifically, in view of the above-described conditions, the number of members and the arrangement thereof are determined under the following conditions:

Among the inwardly extending members, at least three bent members extend inwardly from the inner wall of the cylindrical member in such a manner that they are disposed at equal intervals. Each of the bent members has a base portion which is inclined with respect to a phantom line connecting the base of the bent member to the central axis of the cylindrical member and has a top portion which is set close to the central axis of the cylindrical member because of the inclination of the base portion. The remaining inwardly extending members are arranged in such a manner that one or two linear members extend inwardly from the inner wall of the cylindrical member and between adjacent bent members.

If necessary, a small protrusion is provided on the inner wall of the cylindrical member in such a manner that the protrusion is disposed between a bent member and a straight member which is adjacent to the bent member and on the side towards which the base portion of the bent member is inclined with respect to the above-described phantom line and/or on a side wall of the straight member. The use of small protrusions allows fine adjustment of the gaps between the inwardly extending members so that the gaps are substantially uniform in width.

The pen unit of the invention is manufactured by using an extruder provided with a die having a number of holes suitably arranged. That is, molten thermoplastic synthetic resin is extruded through the die into a number of synthetic resin elements, and simultaneously the synthetic resin elements thus obtained are fused into an endless bar. The endless bar is cut into pieces each having a predetermined length. At least one end portion of each piece of bar is ground to be conical. Examples of the thermoplastic synthetic resin are polyacetal, nylon and polyolefin. If necessary, the outer wall of each piece of bar is subjected to centerless grinding so that it has a predetermined diameter, and then its end portion is ground as described above.

This invention will be explained in detail with respect to the drawings and the description of the preferred embodiment that follows.

DESCRIPTION OF THE PREFERRED EMBODIMENT

Figure 1:
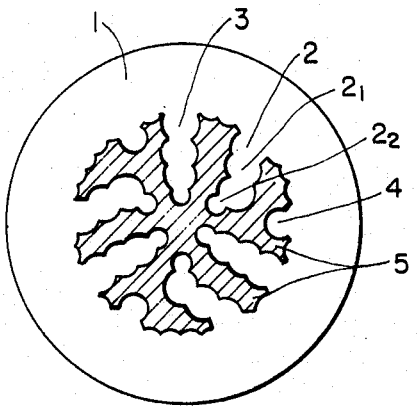
FIGS. 1 through 11 are sectional views of various embodiments of a pen unit according to this invention.
Figure 2:
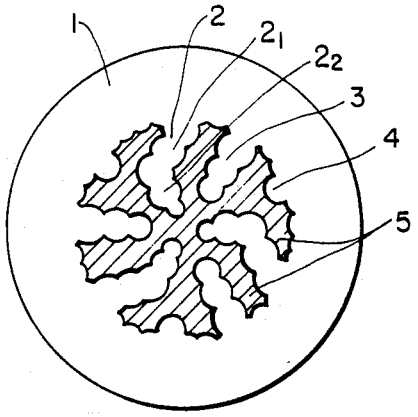

First and second embodiments of a synthetic resin pen unit according to this invention are as shown in FIGS. 1 and 2, respectively. In each of these embodiments, three bent members 2 are provided on a cylindrical member 1 which is substantially annular in section. More specifically, the three bent members 2 are provided at equal circumferential intervals on the cylindrical member 1 and extend radially inwardly from the cylindrical member 1. A linear member 3 extends from the inner wall of the cylindrical member 1 in such a manner that it is between adjacent bent members 2. Accordingly, three linear members extend radially inwardly from the inner wall of the cylindrical member 1. In the examples shown in FIGS. 1 and 2, the linear member is a straight member 3.

A small protrusion 4 is provided on the inner wall of the cylindrical member 1 in such a manner that it is positioned between a bent member 2 and the straight member 3. Specifically, the protrusion 4 is provided on the side towards which the base portion $2_1$ of the bent member 2 that is inclined with respect to a phantom line connecting the base of the bent member 2 to the central axis of the cylindrical member 1, so that gaps 5 between the linear members are equal in width.

Figure 3:
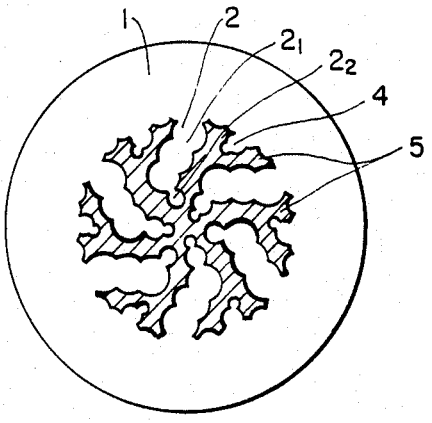

In the embodiment shown in FIG. 3, all the members are bent. The protrusions 4 have a bent portion oriented generally parallel to the bent member 2. In the embodiments of FIGS. 1–3, each of the bent members 2 has a top portion $2_2$ which extends near the central axis of the cylindrical member 1. More specifically, each bent member 2 is bent at its base $2_1$ and is then extended towards the central axis, thus forming the top portion $2_2$. A small protrusion 4 is provided on the inner wall of the cylindrical member 1 in such a manner that it is positioned between adjacent bent members 2.

The pen units shown in FIGS. 1 through 3 are very small in diameter, smaller than 1 mm in diameter. These units increase in flexibility with the FIG. 3 embodiment the most flexible and the FIG. 1 embodiment the least.

Figure 4:
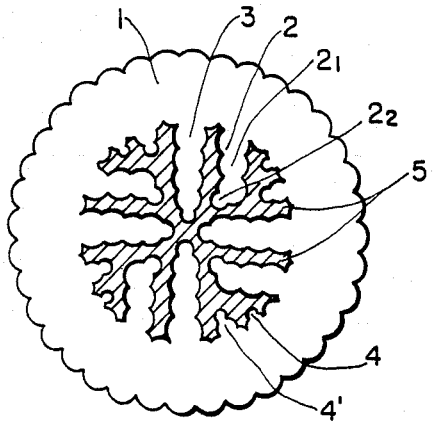
Figure 5:
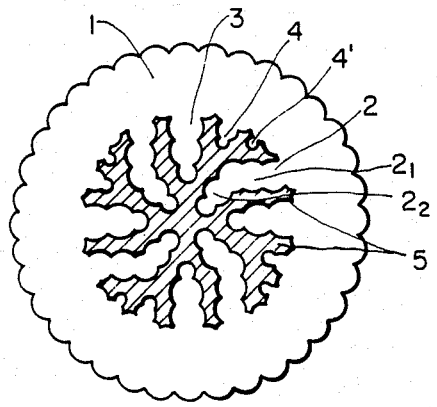

In fourth and fifth embodiments of the synthetic resin pen unit according to the invention shown in FIGS. 4–5, four bent members 2 extend radially inwardly from the inner wall of a cylindrical member 1 in such a manner that they are positioned at equal intervals. A linear member 3 also extends from the inner wall of the cylindrical member 1 in such a manner that it is disposed between adjacent bent members 2. That is, four linear members 3 are provided in each of the examples shown in FIGS. 4 and 5. Two small protrusions 4 and 4' are provided on the inner wall of the cylindrical member 1 in such a manner that they are positioned between a bent member 2 and the linear member 3 which is provided on the side towards which the base portion $2_1$ of the bent member 2 is inclined with respect to a phantom line connecting the base of the bent member 2 to the central axis of the cylindrical member 1. The pen unit shown in FIG. 5 is somewhat more flexible than that in FIG. 4.

Figure 6:
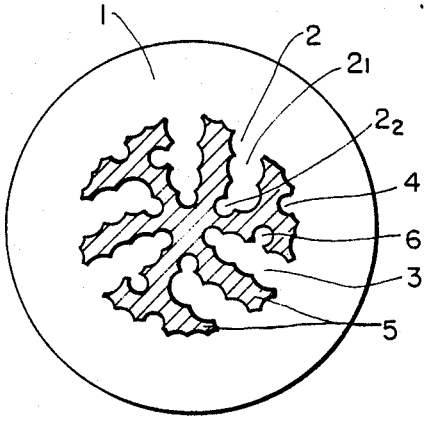
Figure 7:
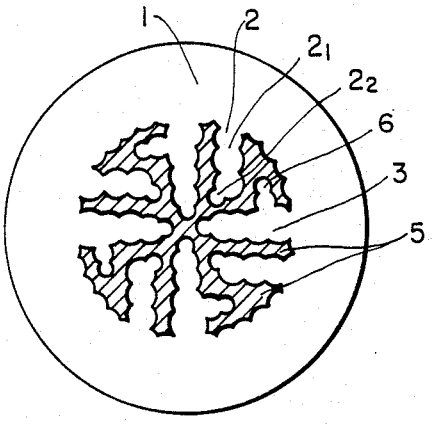

Sixth and seventh embodiments of the pen unit shown respectively in FIGS. 6 and 7 can be obtained by slightly modifying the pen units shown in FIGS. 1 and 4. That is, in the sixth and seventh embodiments, small protrusions (6 or 6') are formed on the side walls of the linear members 3.

Figure 8:
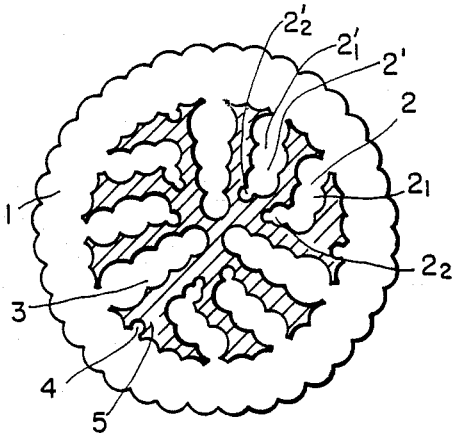
Figure 9:
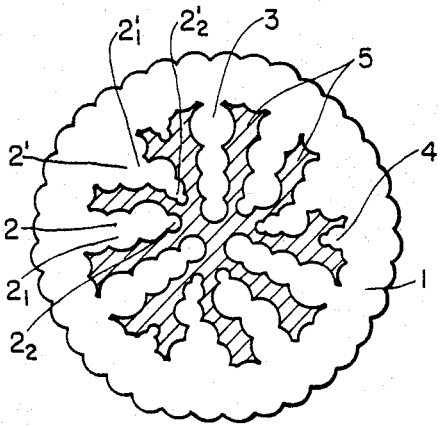
Figure 10:
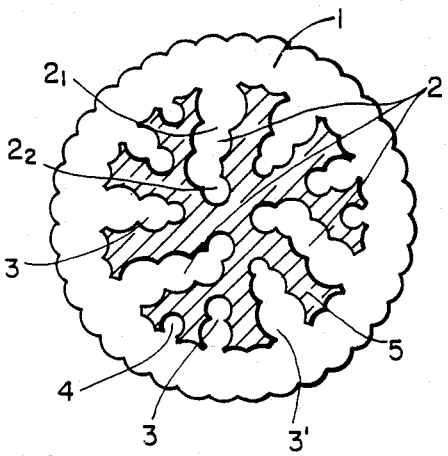

Eighth, ninth and tenth embodiments of the pen unit according to the invention are as shown in FIGS. 8, 9 and 10, respectively. In each of these embodiments, three sets of bent members 2 extend inwardly from the inner wall of a cylindrical member 1 at equal intervals, and two linear members 3, 4 also extend inwardly from the inner wall of the cylindrical member 1 in such a manner that they are disposed between adjacent sets of bent members. In the examples of FIGS. 8 and 9, the linear member comprises a straight member 3 while in the example in FIG. 10, the two linear members are straight members 3 and 3'. In each of the examples shown in FIGS. 8 through 10, a small protrusion 4 is provided on the inner wall of the cylindrical member. It is positioned between a bent member 2 and the straight member 3 which is provided on the side towards which the base portion $2_1$ of the bent member 2 is inclined with respect to a phantom line connecting the base of the bent member 2 to the central axis of the cylindrical member. The pen unit in FIG. 8 is more flexible than the pen units shown in FIGS. 9 and 10. The pen unit shown in FIG. 9 is substantially equal in flexibility to that in FIG. 10.

Figure 11:
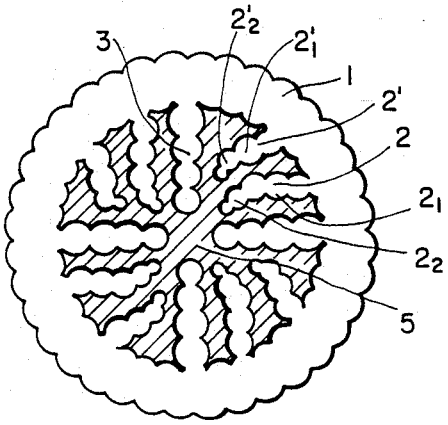

FIG. 11 shows an eleventh embodiment of the pen unit according to the invention. In the example, four bent members 2 extend inwardly from the inner wall of a cylindrical member 1 in such a manner that they are arranged at equal intervals, and a bent member 2' and a straight member 3 extend inwardly from the inner wall of the cylindrical member 1 in such a manner that they are disposed between adjacent bent members 2'. As in the prior embodiments, bent elements 2 and 2' have base and top portions 2 and $2_2$.

The examples shown in FIGS. 4, 5 and 7 through 11 are applicable to pen units about 1 mm to about 2 mm in diameter.

The above-described pen units are different from one another as shown in FIGS. 1 through 11 and accordingly are different in flexibility; however, all of them provide satisfactory writing performance.

What is claimed is:

1. A pen unit comprising, in cross-section, a number of synthetic resin elements fused in the axial direction to form a capillary pen nib, said nib having an outer annular cylindrical member and is hollow at its circumferential center, a plurality of curved bent members extending inwardly from said cylindrical member toward said hollow center, said plurality of curved bent members uniformly circumferentially spaced thereon, said nib devoid of any inwardly extending straight members, said curved bent members comprise alternate long and short bent members and said long bent members comprise a base portion bent in a first direction and a top portion which is bent in a second direction and extending toward the central axis of the pen.

2. The pen unit of claim 1 wherein said short bent members are all bent in the same direction.

3. The pen unit of claim 1, wherein said base portion is comprised of fused members having a first diameter and said top portion is comprised of fused elements having a second diameter which is smaller than that of said first diameter.

* * * * *